US006874452B2

(12) United States Patent
Adams

(10) Patent No.: US 6,874,452 B2
(45) Date of Patent: Apr. 5, 2005

(54) RESONANT COMBUSTION CHAMBER AND RECYCLER FOR LINEAR MOTORS

(76) Inventor: Joseph S. Adams, 481 Beever Point Road, Salt Spring Island, British Columbia (CA)

( * ) Notice: Subject to any disclaimer, the term of this patent is extended or adjusted under 35 U.S.C. 154(b) by 0 days.

(21) Appl. No.: 10/341,745

(22) Filed: Jan. 14, 2003

(65) Prior Publication Data

US 2003/0131809 A1 Jul. 17, 2003

Related U.S. Application Data

(60) Provisional application No. 60/349,293, filed on Jan. 15, 2002.

(51) Int. Cl.[7] ..... F02R 19/02
(52) U.S. Cl. ..... 123/46 R
(58) Field of Search ..... 123/46 R, 46 A, 123/260, 268, 283, 286, 253

(56) References Cited

U.S. PATENT DOCUMENTS

| | | | | |
|---|---|---|---|---|
| 2,886,024 A | * | 5/1959 | Elias | 123/286 |
| 3,363,661 A | | 1/1968 | Horton | 158/27.4 |
| 3,809,022 A | | 5/1974 | Dean, Jr. 123 | 123/8.19 |
| 3,898,965 A | * | 8/1975 | Fischer | 123/286 |
| 3,934,560 A | * | 1/1976 | Dodd | 123/259 |
| 3,983,858 A | * | 10/1976 | Sevald | 123/274 |
| 4,332,224 A | | 6/1982 | Latsch et al. | 123/254 |
| 4,559,911 A | | 12/1985 | Bodine | 123/271 |
| 4,665,868 A | * | 5/1987 | Adams | 123/46 SC |
| 4,759,318 A | * | 7/1988 | Adams | 123/46 SC |
| 4,894,005 A | | 1/1990 | Keller | 431/115 |
| 5,197,434 A | | 3/1993 | Contreras Orellana | 123/433 |
| 5,377,628 A | | 1/1995 | Adams | 123/41.31 |
| 5,540,194 A | | 7/1996 | Adams | 123/46 R |
| 5,715,787 A | | 2/1998 | Kawamura | 123/276 |
| 5,983,624 A | | 11/1999 | Anderson | 60/39.77 |
| 6,098,588 A | * | 8/2000 | Hufnagel | 123/261 |
| 6,213,097 B1 | | 4/2001 | Maucher | 123/465 |
| 6,430,919 B1 | | 8/2002 | Duncan | 60/39.76 |
| 6,460,507 B2 | * | 10/2002 | Thieleke et al. | 123/260 |
| 6,491,002 B1 | | 12/2002 | Adams | |

FOREIGN PATENT DOCUMENTS

| | | |
|---|---|---|
| DE | 42 43 617 A1 | 12/1992 |
| EP | 0 595 473 B1 | 12/1997 |

* cited by examiner

*Primary Examiner*—Henry C. Yuen
*Assistant Examiner*—Jason Benton
(74) *Attorney, Agent, or Firm*—Thomas B. Ryan; Brian B. Shaw, Esq.; Harter, Secrest & Emery LLP

(57) ABSTRACT

A combustion chamber system for a spark-ignited linear motor includes an open-ended primary combustion chamber located within a secondary combustion chamber. An unrestricted opening between the primary and secondary combustion chambers provides for more efficient scavenging of combustion byproducts. A compression wave trigged by a spark-ignited flame front within the primary combustion chamber is reflected within the secondary combustion. Upon return, the compression wave effectively closes the unrestricted opening of the primary combustion chamber by colliding with the flame front and forcing flame jets through smaller openings in the primary combustion chamber into the secondary combustion chamber for accelerating combustion within the secondary combustion chamber.

42 Claims, 10 Drawing Sheets

RESONANT COMBUSTION CHAMBER AND RECYCLER FOR LINEAR MOTORS

This application claims the benefit of U.S. Provisional Application No. 60/349,293, filed on Jan. 15, 2002, which provisional application is incorporated by reference herein.

TECHNICAL FIELD

Spark-ignition combustion-powered linear motors provide on-board power for portable power tools and other devices such as nail guns, staplers, and other fastener driving tools.

BACKGROUND

Typical spark-ignition linear motors of portable power tools operate at or near atmospheric pressure prior to ignition. A mixture of fuel and air is established in a combustion chamber and is ignited by a spark for combusting the mixture and driving a piston actuator of the tool. In order to achieve acceptable levels of efficiency from such motors, some sort of combustion accelerating device is added.

For example, a portion of the charge (i.e., the mix of fuel and air) is held in a pre-combustion (or primary combustion) chamber and is ignited to build sufficient pressure to spew flame jets into the main combustion (or secondary combustion) chamber. The flame jets turbulate and ignite the pre-established mix of fuel and air in the main combustion chamber.

My co-pending application Ser. No. 09/813,058 entitled Combustion Chamber System, which is hereby incorporated by reference, discloses an elongated pre-combustion chamber within which an organized flame front propels a mix of unburned fuel and air through a check valve into the main combustion chamber. The delivery of additional fuel and air into the main combustion chamber increases pressure and generates turbulence in advance of the arrival of the flame front for producing a more robust combustion in the main combustion chamber.

Although increasing power output of spark-ignited linear motors, pre-combustion chambers can present a problem when the combustion chamber needs to be scavenged and the combusted gases replaced with a fresh fuel and air mix. The pre-combustion chamber needs to be opened to circulate scavenging air. Typically, the openings between pre-combustion and main combustion chambers are small to achieve acceptable flame jet velocities, and the scavenging air must pass through the same small openings. The restriction to scavenging and subsequent recharging flows can slow cycle times and reduce scavenging efficiency.

SUMMARY OF INVENTION

My invention contemplates improvements to scavenging efficiency and combustion efficiency. Accompanying the generation of an organized flame front within a combustion chamber is a faster moving compression wave. The combustion chamber can be arranged in accordance with my invention to exploit resonant properties of the compression wave for such purposes as compressing pre-established mixes of fuel and air and redirecting the flame front. A less restrictive scavenging path is possible for simplifying and enhancing scavenging and replenishing operations (i.e., recycling). Enhanced power output is possible by generating additional turbulence and compression within the combustion chamber.

One example of such a combustion chamber system for a combustion-powered linear motor includes a primary combustion chamber in communication with a secondary combustion chamber through a common opening. A spark igniter located within the primary combustion chamber generates a flame front and an accompanying faster moving compression wave. The primary combustion chamber is shaped for guiding the compression wave along a path through the opening between the primary and secondary combustion chambers in advance of the flame front. The primary combustion chamber is also shaped to support propagation of the flame front for propelling unburned fuel and air in advance of the propagating flame front. The secondary combustion chamber is shaped for reflecting the compression wave in a direction that compresses the unburned fuel and air propelled by the propagating flame front for enhancing combustion accompanying the discharge of the flame front into the secondary combustion chamber.

For purposes of enhancing scavenging and recharging operations, the opening between the primary and secondary combustion chambers is preferably an unrestricted opening. However, the unrestricted opening is preferably a first of two openings between the primary and secondary combustion chambers. The unrestricted opening allows the compression wave to reflect from the secondary combustion chamber back into the primary combustion chamber in a direction opposed to a direction of propagation of the flame front within the primary combustion chamber. A second smaller of the two openings is positioned to inject the flame front into the secondary combustion chamber accompanying a collision with the reflected compression wave with the flame front within the primary combustion chamber. Four equally spaced openings are preferred for this purpose to accelerate combustion throughout the secondary combustion chamber. Thus, the returning compression wave effectively closes the unrestricted opening during ignition and forces the flame front through the smaller opening for accelerating combustion within the secondary combustion chamber. Following combustion, the unrestricted opening supports a free flow of scavenging and recharging gases between the primary and secondary combustion chambers.

The primary and secondary combustion chambers are preferably arranged concentrically about a common axis. The primary combustion chamber preferably includes tubular sidewalls for guiding both the flame front and the compression wave along the common axis. The secondary combustion chamber preferably includes tubular sidewalls for guiding the compression wave along the common axis. In addition, the secondary combustion chamber preferably includes two parallel end faces for reflecting the compression wave between them along the common axis. One of the parallel end faces is preferably formed by a face of a piston that is driven by combustion in the secondary combustion chamber. The opening between the primary and secondary combustion chambers preferably extends normal to the common axis.

In one particular configuration, the primary combustion chamber is surrounded by the secondary combustion chamber throughout a common length along the common axis. An exhaust valve is preferably located in the primary combustion chamber. The opening is preferably unrestricted and a first of two openings. A second smaller of the two openings is located along the common axis between the exhaust valve and the unrestricted opening. Following combustion, a flow of air can be directed through the unrestricted opening into the primary combustion chamber before exiting through an exhaust valve for scavenging residual combustion products from the primary and secondary combustion chambers.

Combustion is preferably initiated in a spark-ignition combustion-powered motor in accordance with my invention by first establishing a mix of fuel and air in both a primary combustion chamber and a secondary combustion chamber. A flame front is ignited producing a faster compression wave. The flame front and the compression wave propagate at different speeds along the primary combustion chamber, the flame front propelling an unburned portion of the mix of fuel and air along the primary combustion chamber. The compression wave propagates through an opening into the secondary combustion chamber in advance of the flame front. Within the secondary combustion chamber, the compression wave is reflected on a return path that collides with the propagating flame front to accelerate combustion of the mix of fuel and air in the secondary combustion chamber at an elevated pressure.

The compression wave preferably propagates through an unrestricted opening between the primary and secondary combustion chambers. The reflected compression wave returns through the unrestricted opening and collides with the propagating flame front within the primary combustion chamber. The returning compression wave effectively closes the opening for compressing the unburned fuel and air in advance of the propagating flame front. The collision between the reflected compression wave and the propagating flame front forces a flame jet through one or more smaller openings between the primary and secondary combustion chambers for accelerating combustion of the mix of fuel and air in the secondary combustion chamber.

Preferably, the compression wave is reflected from opposite ends of the secondary combustion chamber to establish a desired resonance. The reflections from one of the opposite ends can be split between the primary and secondary combustion chambers. The split reflection provides for both colliding with the propagating flame front and compressing the mix of fuel and air within the secondary combustion chamber.

A dual piston actuator can also participate in the recycling operations. The dual piston actuator has two concentric sections. The inner concentric section is received in a central bore of a motor housing and the outer concentric section is received in a peripheral annular bore of the motor housing. A downward stroke of the dual piston under compression displaces air from the central bore through a check valve into a plenum and displaces air from the annular bore to an exhaust valve actuator. After the piston reaches the bottom of its stroke, an intake valve is opened to allow air into the central bore. Pressurized air flowing into the peripheral annular bore from the plenum provides for returning the dual piston to the top of its stroke.

As the piston approaches the top of its stroke, a recess within the annular bore allows air from the plenum to flow into the secondary chamber. From there, the air flows through the unrestricted opening into the primary chamber and out the exhaust valve for scavenging combustion byproducts from both chambers. As air pressure in the plenum drops, the exhaust valve is closed, and fuel is injected into both combustion chambers for replenishing the combustible mix of fuel and air. The free flow of scavenging air through both combustion chambers is enhanced not only by the unrestricted opening between the chambers but also by a tubular form of both chambers that further supports flows through the chambers.

DRAWINGS

DETAILED DESCRIPTION

Figure 1:
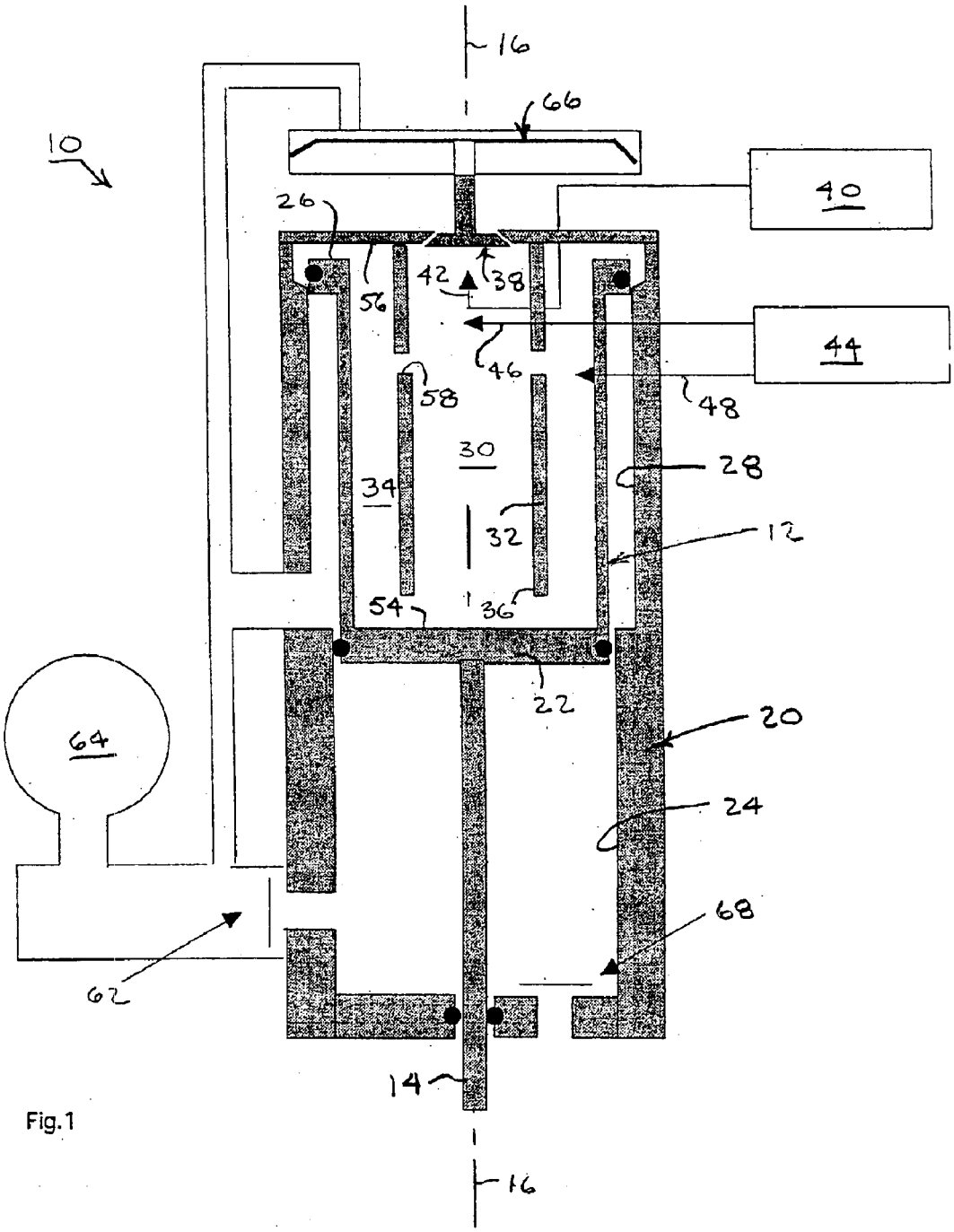
FIG. 1 is a cross-sectional diagram of a spark-ignited combustion powered linear motor arranged in accordance with an embodiment of my invention.

An exemplary spark-ignition combustion-powered linear motor 10 for a portable power tool is shown in progressive stages of operation throughout FIGS. 1–10. The motor 10 has a dual piston actuator 12 with a rod 14 for communicating the power to the portable tool (not shown). The piston actuator 12 is guided along a reference axis 16 within a cylinder housing 20. An inner concentric section 22 of the dual piston actuator 12 is guided within a central bore 24 of the cylinder housing 20, and an outer concentric section 26 of the dual piston actuator 12 is guided within a peripheral annular bore 28 of the cylinder housing 20.

A primary combustion chamber 30 occupies a cylindrical space within an open-ended tube 32. A secondary combustion chamber 34 occupies an annular space surrounding the open-ended tube 32. The primary and secondary combustion chambers 30 and 34 are arranged concentrically about the reference axis 16. An unrestricted opening 36 formed at one end of the open-ended tube 32 supports unrestricted flows between the primary and secondary combustion chambers 30 and 34. The substantially uninterrupted tubular wall construction of the primary and secondary combustion chambers 30 and 34 also promotes free flows along and between the primary and secondary combustion chambers 30 and 34. An exhaust valve 38 formed at the other end of the open-ended tube 32 provides for exhausting flows from the primary combustion chamber 30 to atmosphere.

An ignition coil 40 delivers a spark within the primary combustion chamber 30 through an electrode 42. A fuel injector 44 injects fuel into both the primary and secondary combustion chambers 30 and 34 along lines 46 and 48. Fuel is injected in the form of a mist to establish a mix of fuel and air throughout the primary and secondary combustion chambers 30 and 34.

Figure 2:
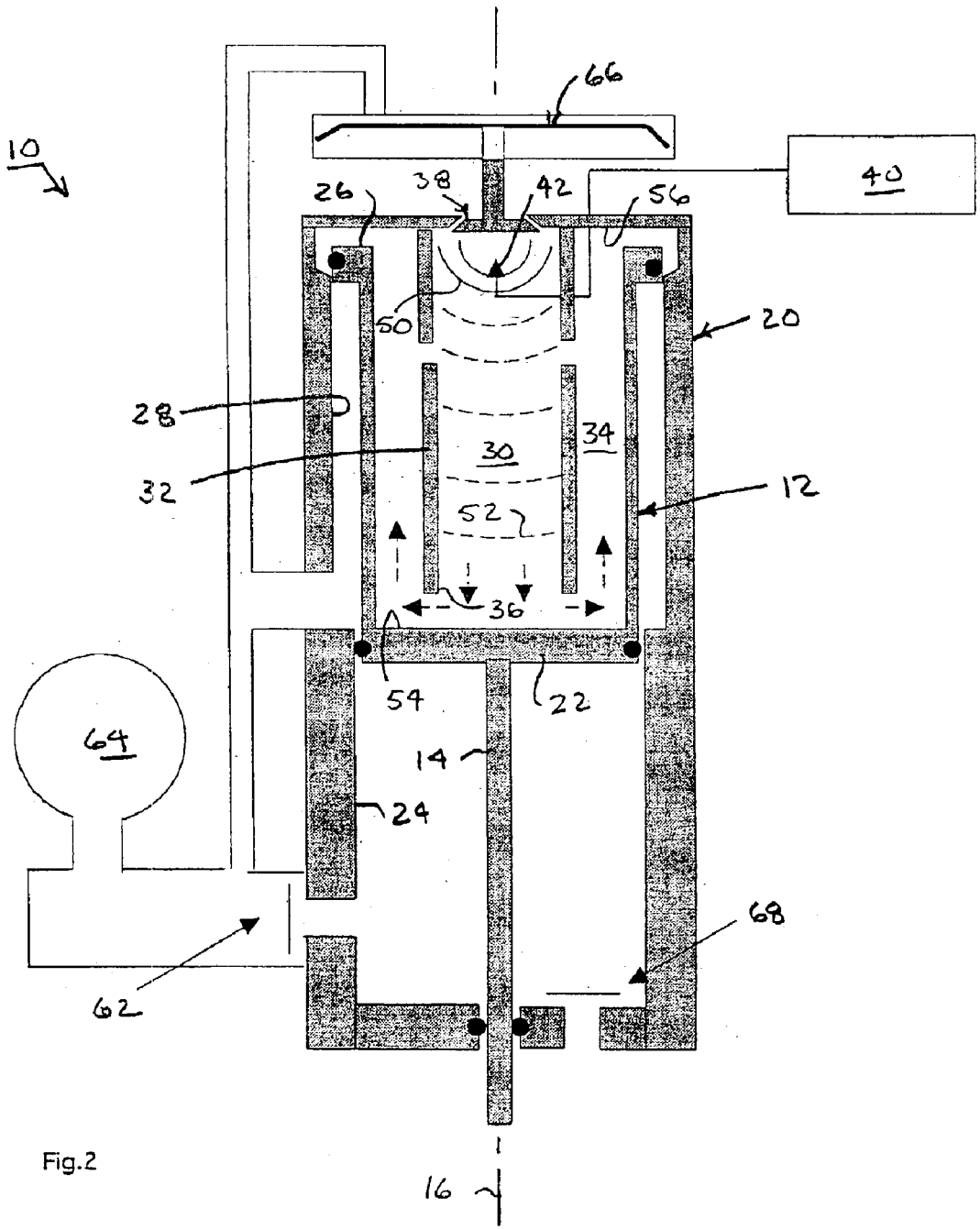
FIG. 2 is a similar view of the same motor showing the generation of a flame front and an accompanying faster compression wave produced by a spark ignition within a primary combustion chamber.

Combustion is initiated in the primary combustion chamber 30 as shown in FIG. 2. A spark produced by the ignition coil 40 ignites a local mixture of fuel and air generating a flame front 50 (shown in arcuate full line) and an accompanying compression wave 52 (shown in arcuate dashed line). Both the flame front 50 and the accompanying compression wave 52 propagate along the reference axis 16 within the primary combustion chamber 30. The flame front 50 advances at a typical rate of about 100 feet per second, and the compression wave 52 advances at a typical rate of about 1000 feet per second (the speed of sound).

Figure 3:
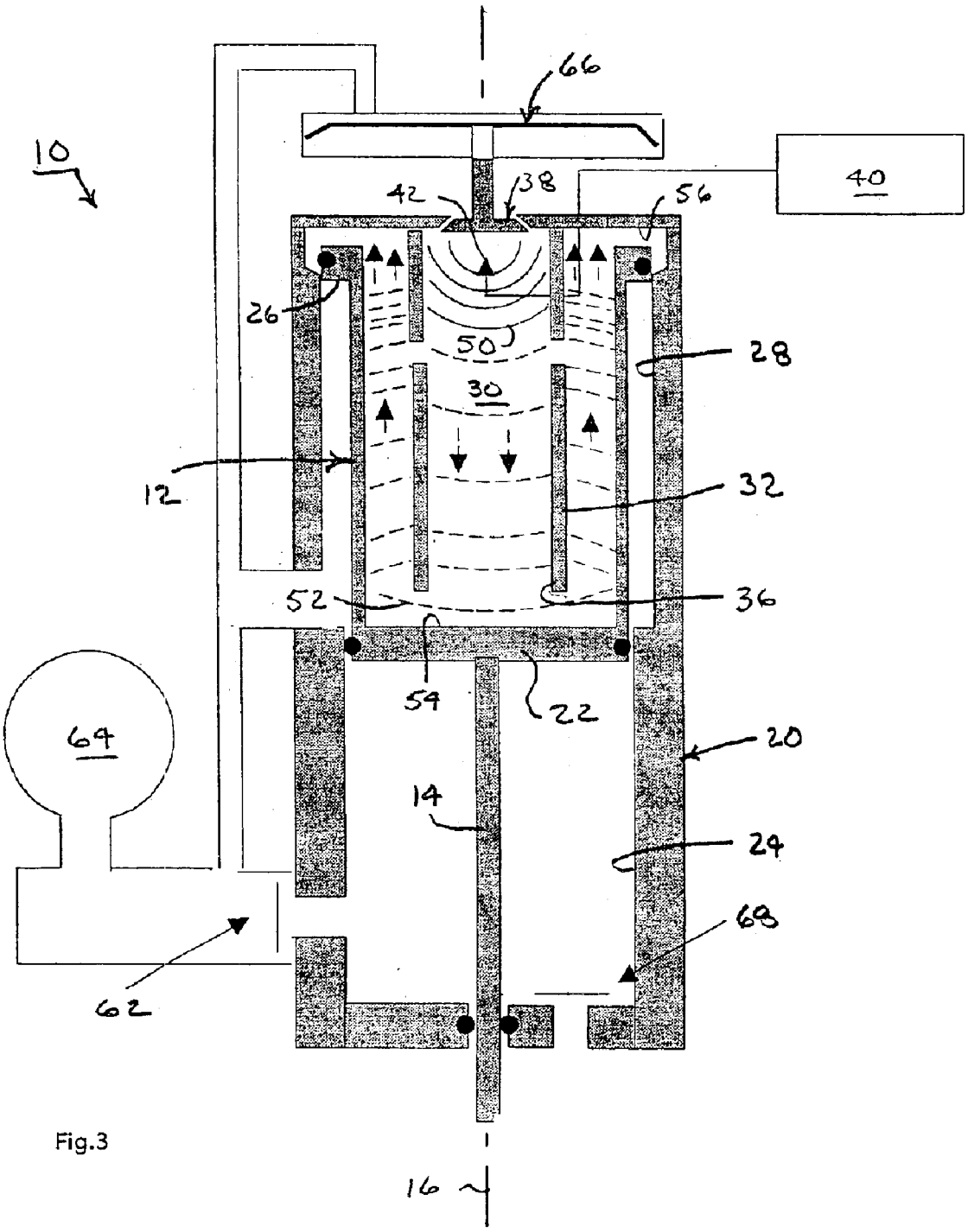
FIG. 3 is a similar view of the same motor showing propagation of the flame front within the primary combustion chamber and the further propagation of the faster compression wave in the secondary combustion chamber.
Figure 4:
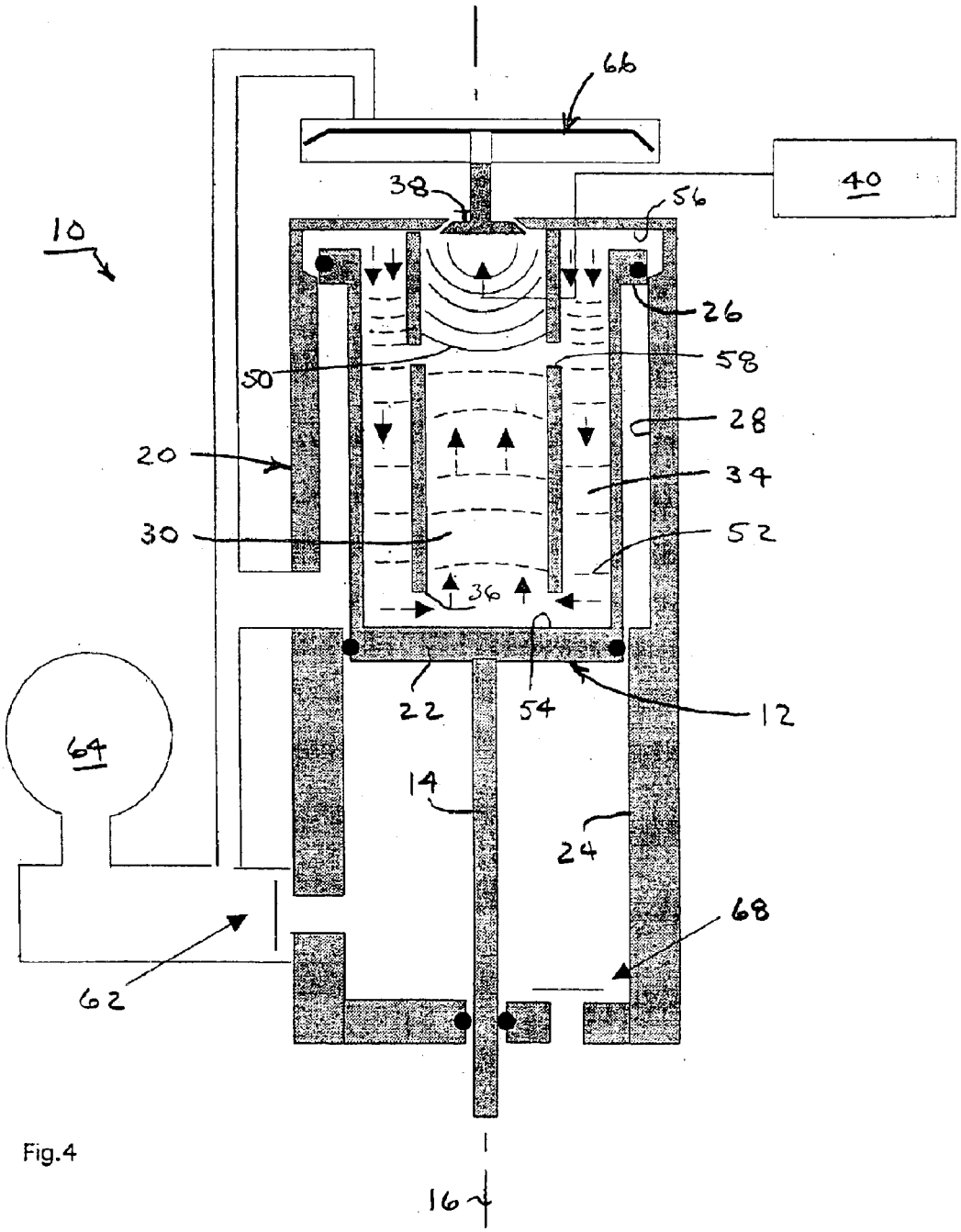
FIG. 4 is a similar view of the same motor showing a reflection of the compression wave.

With reference to FIGS. 3 and 4, the compression wave 52 propagates well in advance of the flame front 50, passing through the unrestricted opening 36 and reflecting between parallel end walls 54 and 56 of the secondary combustion chamber 34. Propagation of the compression wave 52 within the secondary combustion chamber 34 compresses unburned fuel and air approaching the farthest end 56 of the secondary combustion chamber 34. Meanwhile, the slower moving flame front 50 propels an unburned mix of fuel and air in advance of the flame front 50 within the pre-combustion chamber.

Figure 5:
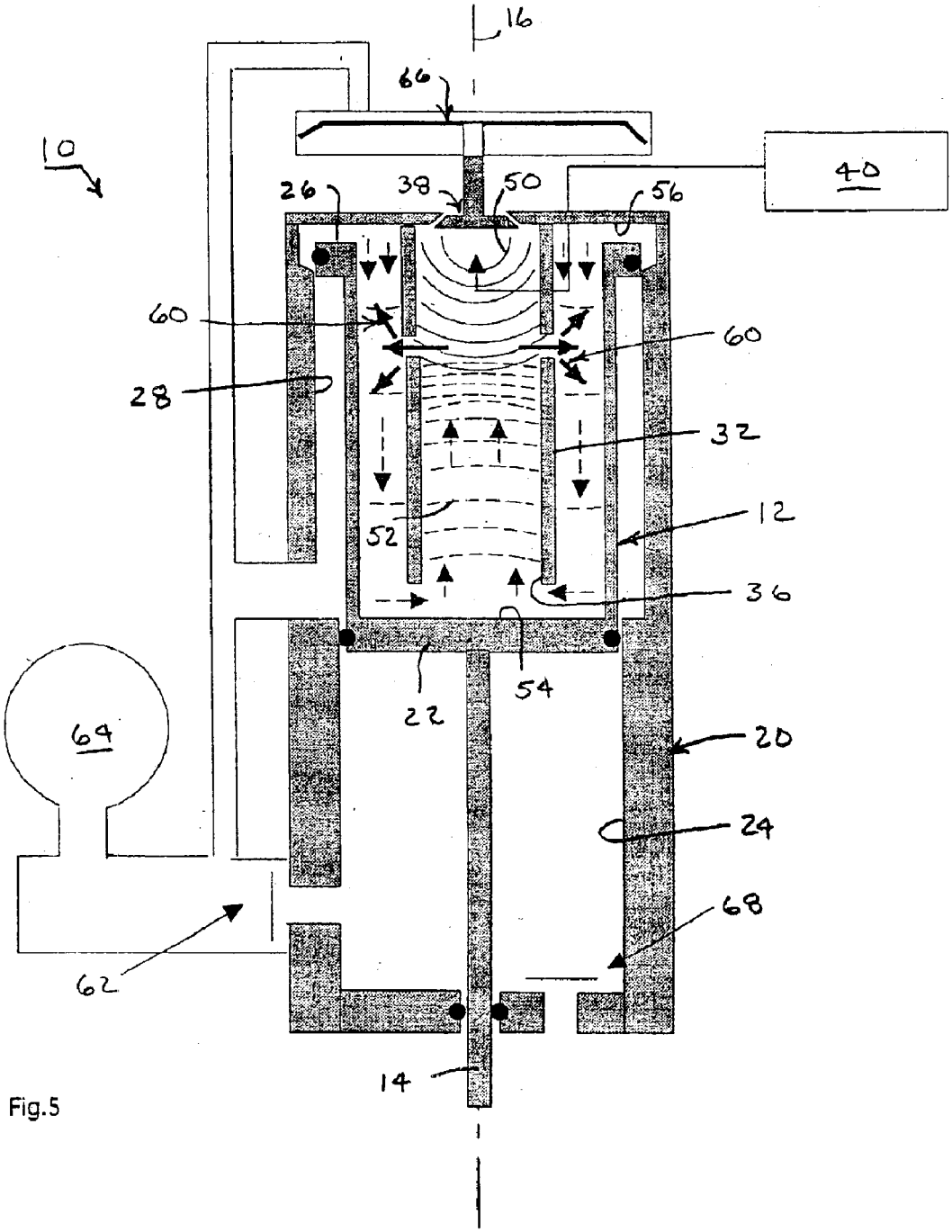
FIG. 5 is a similar view of the same motor showing a collision of the reflected compression wave with the flame front having the effect of forcing flame jets into the secondary combustion chamber.
Figure 6:
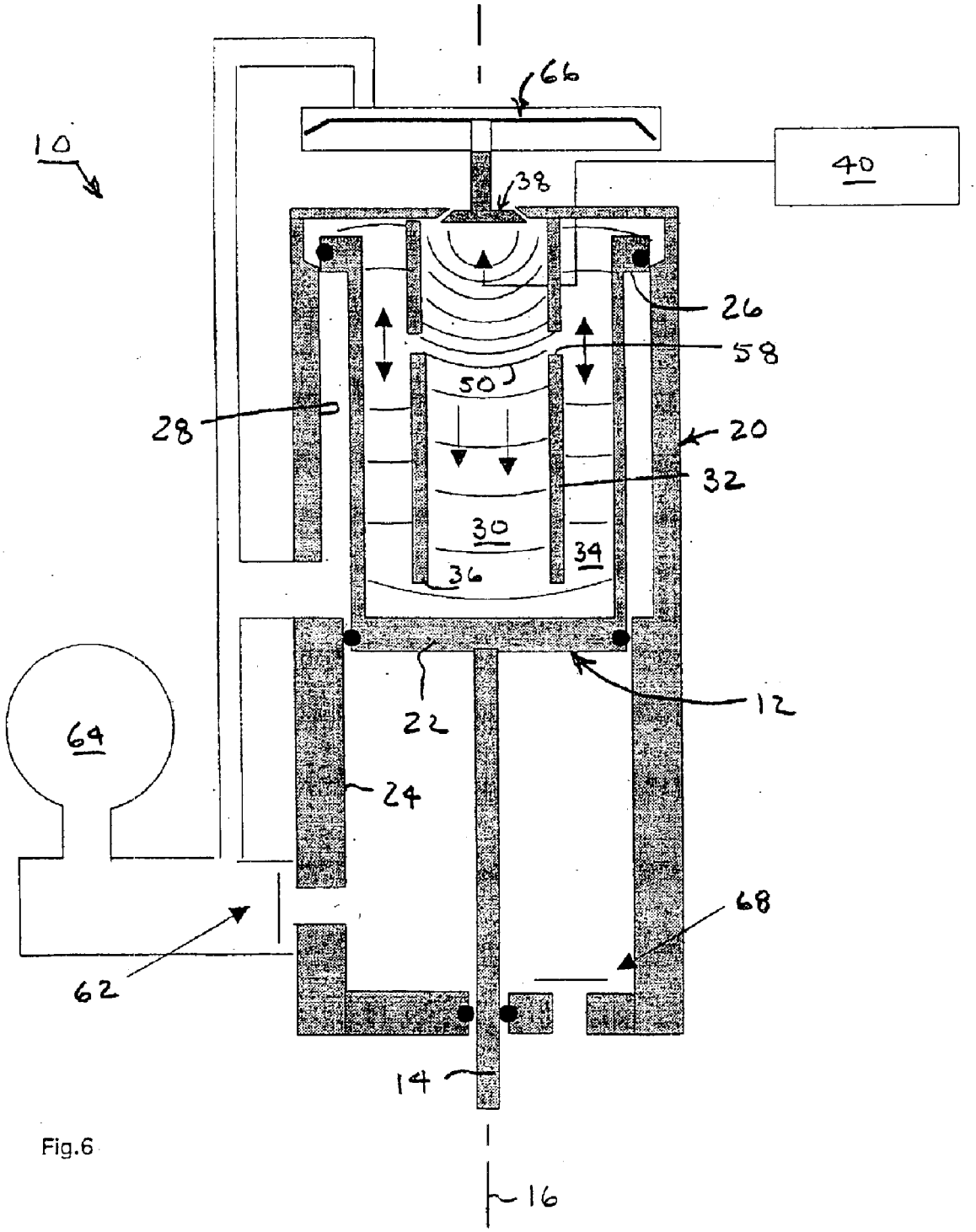
FIG. 6 is a similar view of the same motor showing accelerated combustion within the primary and secondary combustion chambers.

The reflected compression wave 52 returns to the pre-combustion chamber as shown in FIG. 5 and collides with the advancing flame front 50. The collision, which is timed to take place in the vicinity of plurality of small openings 58 through the open-ended tube 32, compresses the unburned fuel and air in advance of the flame front 50 and forces flame jets 60 through the openings 58 into the secondary combustion chamber 34. Preferably, four or more of the openings 58 are distributed radially about the reference axis 16 in a common plane to distribute the flame jets 60 throughout a surrounding region of the secondary combustion chamber 34. The flame jets 60 produce additional turbulence within the remaining mix of fuel and air and accelerate combustion within the secondary combustion chamber, characterized by a more rapid flame propagation rate and pressure against the dual piston actuator 12 as shown in FIG. 6.

Figure 7:
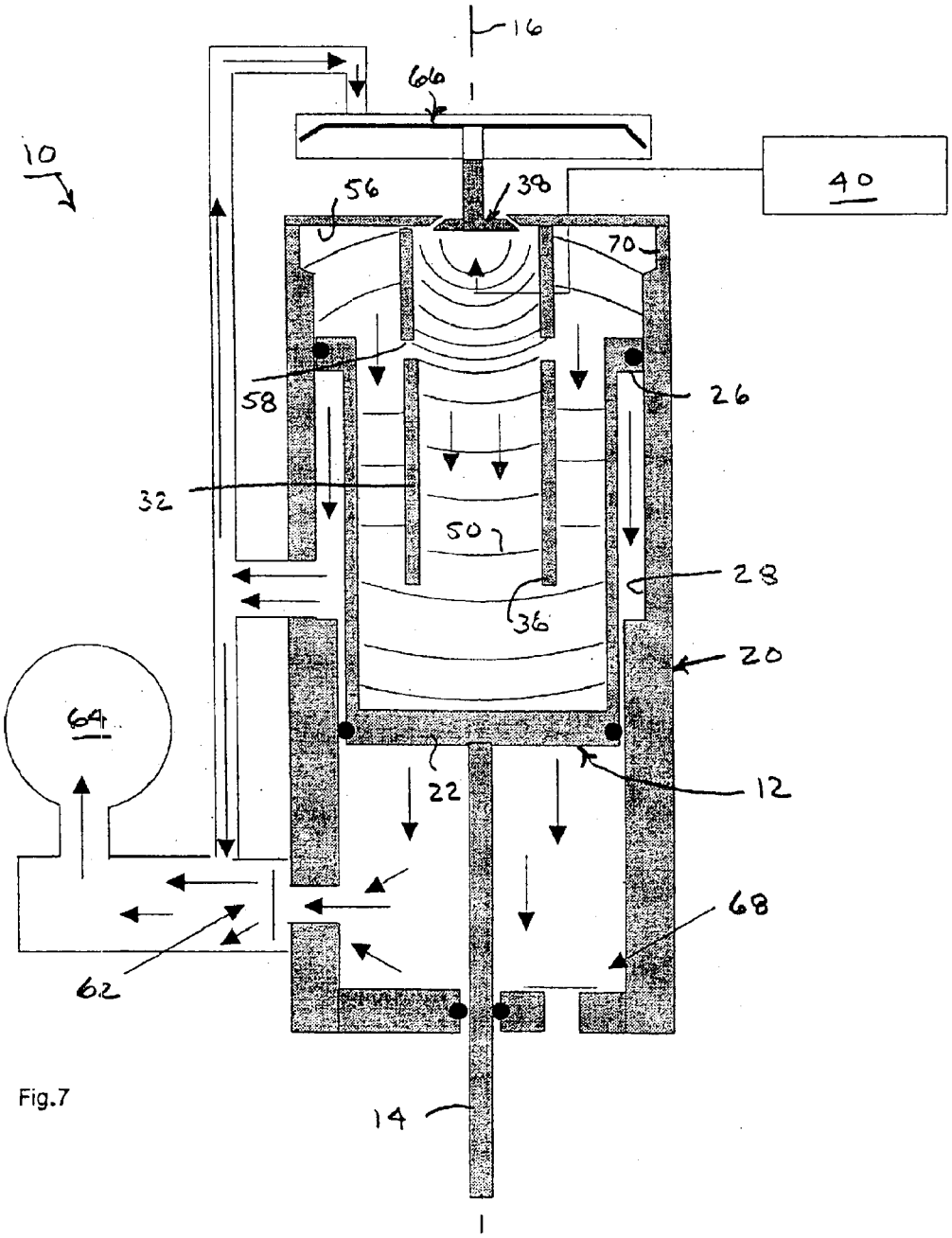
FIG. 7 is a similar view of the same motor showing a displacement of air into a plenum by a dual piston actuator driven by combustion.
Figure 8:
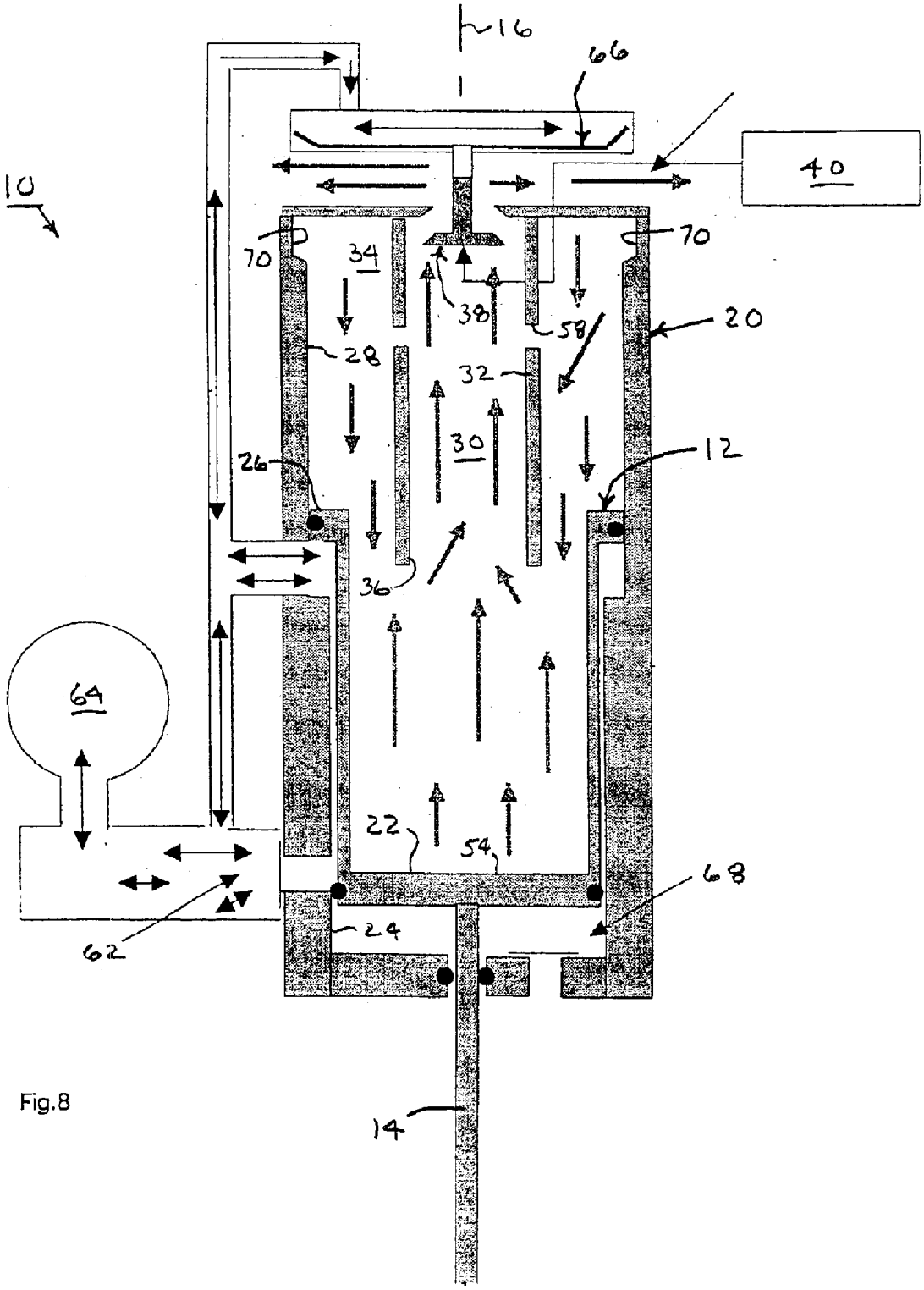
FIG. 8 is a similar view of the same motor showing an exhaust valve opened by air flow from the plenum for exhausting combustion byproducts from the primary and secondary combustion chambers.

As the piston actuator 12 is driven down by the resulting explosion, as shown by FIG. 7, air within the central bore 24 is pushed through an outlet valve 62 (e.g., a check valve) into a pressurizable plenum 64. Air within the peripheral annular bore 28 is also pushed into the plenum 64, which also communicates with a diaphragm actuator 66 for the exhaust valve 38. Accumulating pressure in the plenum 64 opens the exhaust valve 38 as shown in FIG. 8, which depicts the stroke bottom of the piston actuator 12. Residual combustion pressure is released through the exhaust valve 38 allowing the piston actuator 12 to begin its return toward the top of its stroke.

Figure 9:
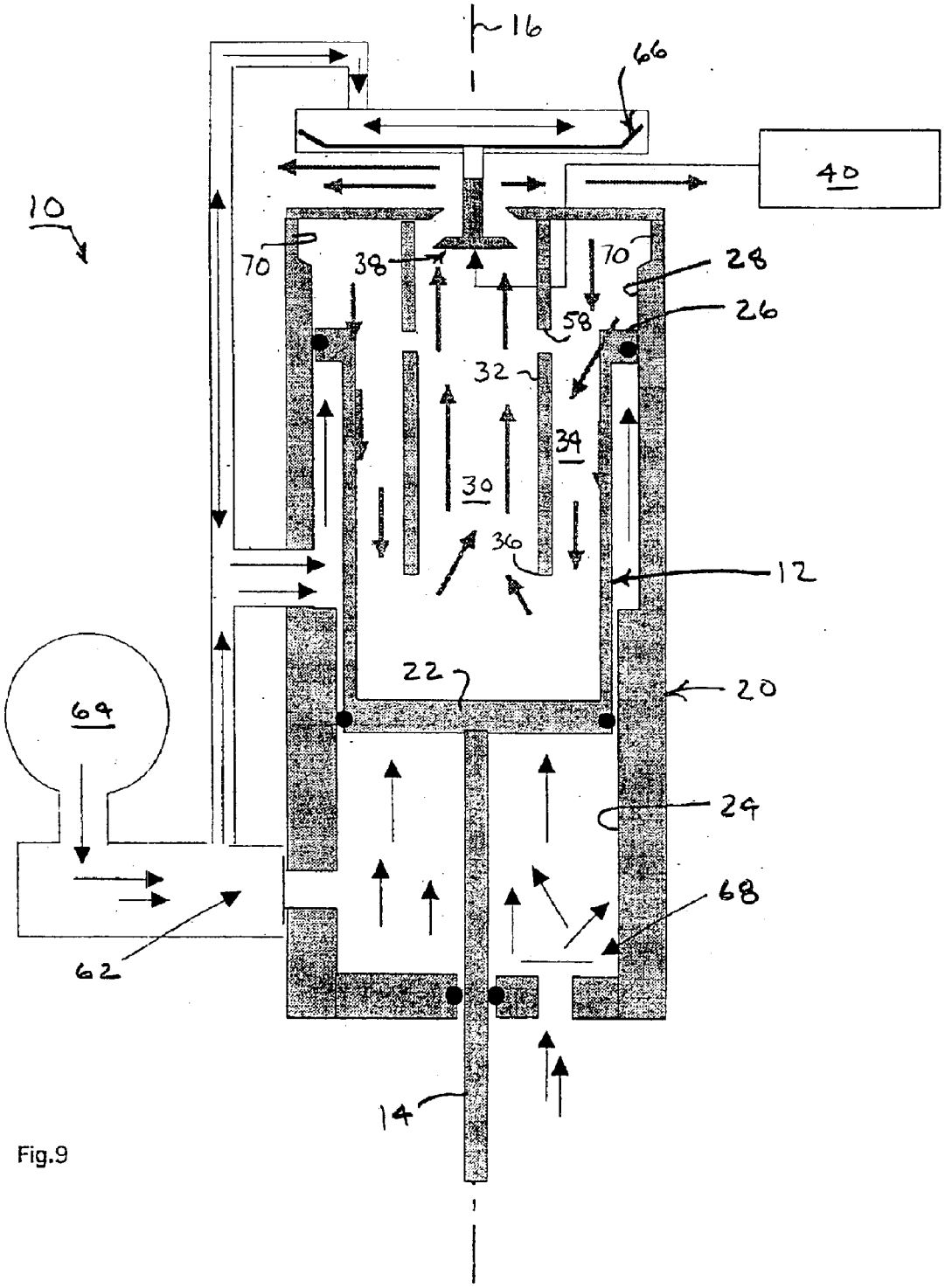
FIG. 9 is a similar view of the same motor showing air pressure from the plenum being used to return the dual piston actuator and an intake valve being opened to allow air to fill space vacated by the returning piston actuator.

The piston actuator 12 is returned, as shown in FIG. 9 by pressurized air from the plenum 64, which is admitted into the peripheral annular bore 28 and which acts against the outer peripheral section 26 of the piston actuator 12. Meanwhile, intake valve 68 (e.g., a check valve) allows air to be replaced within the central bore 24 for occupying the space vacated by the returning piston actuator 12.

Figure 10:
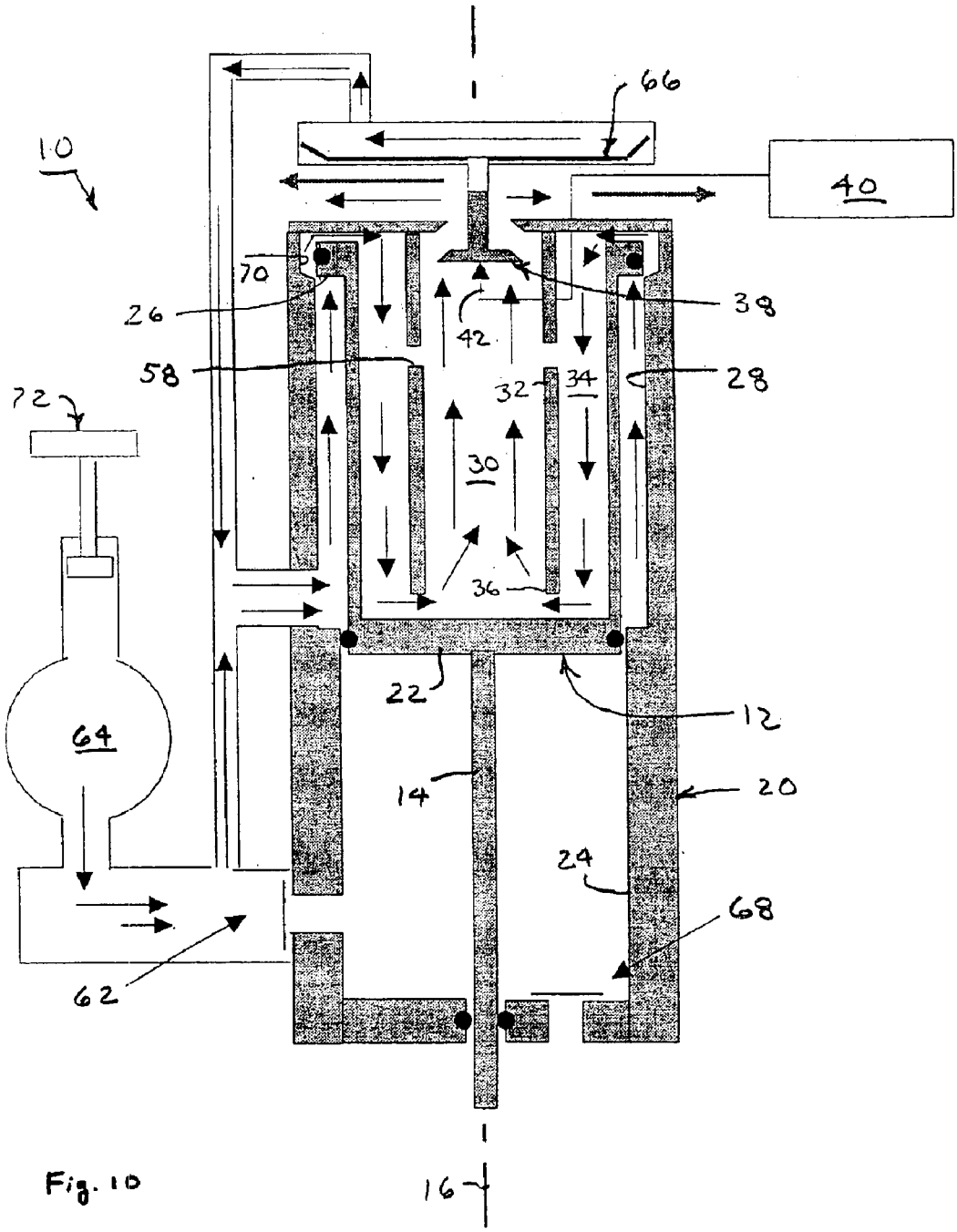
FIG. 10 is a similar view of the same motor showing air flow from the plenum being used to transport combustion byproducts along an substantially uninhibited path from the secondary combustion chamber, through the unrestricted opening, into the primary combustion chamber, and out the exhaust valve.

Near the top of the piston actuator's return stroke, as shown in FIG. 10, its outer peripheral section 26 encounters a recess 70 within the peripheral annular bore 28, which allows a remaining portion of the compressed air from the plenum 64 to enter the secondary combustion chamber 34. The air entering the secondary combustion chamber 34 performs a scavenging function through both the primary and secondary combustion chambers 30 and 34 for removing combustion byproducts through the exhaust valve 38. Both the unrestricted opening 36 between the primary and secondary combustion chambers 30 and 34 and the largely uninterrupted tubular construction of the primary and secondary combustion chambers 30 and 34 contribute to the efficiency of this scavenging operation.

As the pressure in the plenum 64 decreases further, the exhaust valve 38 closes and the fuel injector 44 injects more fuel into the primary and secondary combustion chambers 30 and 34 to re-establish a combustible mix of fuel and air in preparation for repeating the cycle shown first in FIG. 1. A pump 72, as shown in FIG. 10, can be fitted to the plenum 64 to prime the motor 10 for its first cycle.

Although details of the invention have been set forth in a description of certain preferred embodiments, other variations, especially those attuned to specific applications, will be evident to those of skill in the art in accordance with the overall teaching of the invention. Many applications of the invention are expected for piston-driven tools, but the invention is also applicable to other devices including plunger-driven and other displacement devices.

I claim:

1. A combustion chamber system for a combustion-powered linear motor comprising:

a primary combustion chamber in communication with a secondary combustion chamber;

first and second openings between the primary and secondary combustion chambers;

a spark igniter located within the primary combustion chamber and arranged for generating a flame front and an accompanying faster moving compression wave;

the primary combustion chamber being shaped for guiding the compression wave along a path through the first opening from the primary combustion chamber into the secondary combustion chamber in advance of the flame front;

the primary combustion chamber also being shaped to support propagation of the flame front for forcing unburned fuel and air in advance of the propagating flame front; and the secondary combustion chamber being shaped for reflecting the compression wave back through the first opening into the primary combustion chamber in a direction that compresses the unburned fuel and air advanced by the propagating flame front and that discharges the flame front through the second opening into the secondary combustion chamber for accelerating combustion.

2. The system of claim 1 in which the first opening between the primary and secondary combustion chambers is an unrestricted opening between the primary and secondary combustion chambers.

3. The system of claim 1 in which the second opening between the primary and secondary combustion chambers is a smaller than the first opening between the primary and secondary combustion chambers.

4. The system of claim 3 in which the first opening is positioned to allow the compression wave to reflect from the secondary combustion chamber back into the primary combustion chamber in a direction opposed to a direction of propagation of the flame front within the primary combustion chamber.

5. The system of claim 4 in which the second opening is positioned to inject the flame front into the secondary combustion chamber accompanying a collision of the reflected compression wave with the flame front within the primary combustion chamber.

6. The system of claim 5 in which the second opening is itself one of a plurality of openings for more widely distributing the flame jets from the flame front into the secondary combustion chamber.

7. The system of claim 1 in which the primary and secondary combustion chambers extend along a common axis and at least partially overlap along the common axis.

8. The system of claim 7 in which the primary combustion chamber includes tubular side walls for guiding both the flame front and the compression wave along the common axis and the second opening is formed through one of the tubular side walls of the primary combustion chamber.

9. The system of claim 8 in which the secondary combustion chamber includes tubular side walls for guiding the compression wave along the common axis, and a portion of the tubular side walls of the secondary combustion chamber overlaps a portion of the tubular side walls of the primary combustion chamber along the common axis.

10. The system of claim 9 in which the secondary combustion chamber includes two parallel end faces for reflecting the compression wave between them along the common axis.

11. The system of claim 10 in which one of the parallel end faces is formed by a face of a piston that is driven by combustion in the secondary combustion chamber.

12. The system of claim 11 in which the first and second openings are oriented in different directions.

13. The system of claim 7 in which the primary combustion chamber is surrounded by the secondary combustion chamber throughout a common length along the common axis.

14. The system of claim 13 in which an exhaust valve is located in the primary combustion chamber.

15. The system of claim 14 in which the second opening is smaller than the first opening.

16. The system of claim 15 in which the second smaller of the two openings is located along the common axis between the exhaust valve and the first opening.

17. The system of claim 16 in which the second opening is itself one of a plurality of smaller openings between the primary and secondary chambers distributed around the common axis in a common plane.

18. The system of claim 1 further comprising passageways for establishing a mix of fuel and air in both the primary and secondary combustion chambers prior to ignition.

19. The system of claim 1 further comprising a passageway through the first opening for scavenging fuel and air from both the primary and secondary combustion chambers following combustion.

20. The system of claim 19 in which the first opening is an unrestricted opening that provides unrestricted scavenging between the primary and secondary combustion chambers.

21. A method of initiating combustion in a spark-ignition combustion-powered motor comprising steps of:

establishing a mix of fuel and air in both a primary combustion chamber and a secondary combustion chamber;

igniting a flame front and producing a faster compression wave; propagating the flame front and the compression wave at different speeds along the primary combustion chamber, the flame front propelling an unburned portion of the mix of fuel and air along the primary combustion chamber;

propagating the compression wave through an opening into the secondary combustion chamber in advance of the flame front;

reflecting the compression wave on a return path that collides with the propagating flame front to accelerate combustion of the mix of fuel and air in the secondary combustion chamber at an elevated pressure.

22. The method of claim 21 in which the opening into the secondary combustion chamber is an unrestricted opening, and the compression wave propagates through the unrestricted opening between the primary and secondary combustion chambers.

23. The method of claim 21 in which the reflected compression wave returns through the opening and collides with the propagating flame front within the primary combustion chamber.

24. The method of claim 23 in which the returning compression wave effectively closes the opening for compressing the unburned fuel and air in advance of the propagating flame front.

25. The method of claim 23 in which the collision between the reflected compression wave and the propagating flame front forces a flame jet through another opening between the primary and secondary combustion chambers for accelerating combustion of the mix of fuel and air in the secondary combustion chamber.

26. The method of claim 25 in which the collision forces flame jets through a plurality of openings between the primary and secondary combustion chambers for accelerating combustion throughout the secondary combustion chamber.

27. The method of claim 21 in which the step of reflecting includes reflecting the compression wave from opposite ends of the secondary combustion chamber.

28. The method of claim 27 in which the reflections from one of the opposite ends are split between the primary and secondary combustion chambers.

29. The method of claim 28 in which the split reflection provides for both colliding with the propagating flame front and compressing the mix of fuel and air within the secondary combustion chamber.

30. A method of enhancing scavenging in a spark-ignition combustion-powered motor comprising steps of:

igniting a flame front and generating an associated compression wave within a primary combustion chamber;

propagating both the flame front and the compression wave at different speeds along the primary combustion chamber;

propagating the compression wave through an unrestricted opening between the primary combustion chamber and a secondary combustion chamber into the secondary combustion chamber;

reflecting the compression wave back through the unrestricted opening an a return path that collides with the flame front and forces flame jets through another opening between the primary and secondary combustion chambers to accelerate combustion in the secondary combustion chamber; and directing a flow of air that passes through the unrestricted opening into the primary combustion chamber before exiting through an exhaust valve for scavenging residual combustion products from the primary and secondary combustion chambers.

31. The method of claim 30 including the further step of opening an exhaust valve in the primary combustion chamber to exhaust the residual combustion products transported by the air flow through the unrestricted opening between the primary and secondary combustion chambers.

32. The method of claim 31 in which combustion in the primary chamber drives a piston actuator that displaces air into a plenum, and the step of directing includes directing pressurized air from the plenum into the secondary combustion chamber.

33. The method of claim 32 in which prior to the step of directing air into the secondary combustion chamber, pressurized air from the plenum is used to open the exhaust valve and return the piston actuator toward its pre-combustion position.

34. The method of claim 30 in which the step of directing includes directing the flow of air through a substantially uninterrupted annular space of the secondary combustion chamber and through a substantially uninterrupted cylindrical space of the primary combustion chamber.

35. A spark-ignition combustion powered linear motor comprising:

a piston actuator within a motor housing; primary and secondary combustion chambers within the motor housing;

a spark igniter within the primary combustion chamber; an exhaust valve formed at one end of the primary combustion chamber;

a first opening being formed at another end of the primary combustion chamber to permit free flows of air between the primary and secondary combustion chambers; and a second smaller opening formed between the primary and secondary combustion chambers along a length of the primary combustion chamber between the two ends of the primary combustion chamber to inject flame jets from the primary combustion chamber into the secondary combustion chamber.

36. The motor of claim 35 in which the primary combustion chamber is surrounded by the secondary combustion chamber.

37. The motor of claim 36 in which a tube separates the primary and secondary combustion chambers, the primary chamber comprising a cylindrical space within the tube and the secondary chamber comprising an annular space surrounding the tube.

38. The motor of claim 37 in which the tube is and open-ended tube and an open end of the tube forms the substantially unrestricted opening.

39. The motor of claim 38 in which the second smaller opening is one of a plurality of smaller openings formed around the tube for injecting flame jets into the secondary combustion chamber.

40. The motor of claim 35 further comprising a pressurizable plenum that stores air displaced by the dual piston and delivers air into the secondary combustion chamber that passes through the unrestricted opening into the primary combustion chamber before exiting through an exhaust valve for scavenging residual combustion products from the primary and secondary combustion chambers.

41. The motor of claim 40 in which the piston is a dual piston having an inner concentric section guided by a central bore of the motor housing and an outer concentric section guided in a surrounding annular bore of the motor housing.

42. The motor of claim 41 further comprising a recess within the surrounding annular bore for admitting air from the plenum into the secondary combustion chamber.

* * * * *

UNITED STATES PATENT AND TRADEMARK OFFICE

CERTIFICATE OF CORRECTION

PATENT NO. : 6,874,452 B2
DATED : April 5, 2005
INVENTOR(S) : Joseph Adams

It is certified that error appears in the above-identified patent and that said Letters Patent is hereby corrected as shown below:

Title page,
Item [57], ABSTRACT,
Line 6, replace "trigged" with -- triggered --.

Column 4,
Line 32, replace "an" with -- a --.

Column 6,
Line 58, delete "a".

Column 8,
Line 55, replace "an" with -- on --.

Column 10,
Line 11, replace "and" with -- an --.

Signed and Sealed this

Eleventh Day of April, 2006

JON W. DUDAS
*Director of the United States Patent and Trademark Office*